US009577362B1

(12) United States Patent
Snyder et al.

(10) Patent No.: US 9,577,362 B1
(45) Date of Patent: Feb. 21, 2017

(54) ELECTRICAL CONNECTOR ASSEMBLY

(71) Applicant: Amphenol Corporation, Wallingford, CT (US)

(72) Inventors: Jacob C. Snyder, Masonville, NY (US); Brendon A. Baldwin, Guilford, NY (US)

(73) Assignee: AMPHENOL CORPORATION, Wallingford, CT (US)

( * ) Notice: Subject to any disclaimer, the term of this patent is extended or adjusted under 35 U.S.C. 154(b) by 0 days.

(21) Appl. No.: 14/937,580

(22) Filed: Nov. 10, 2015

(51) Int. Cl.
*H01R 13/502* (2006.01)
*H01R 43/16* (2006.01)

(52) U.S. Cl.
CPC ..... *H01R 13/502* (2013.01); *H01R 43/16* (2013.01)

(58) Field of Classification Search
USPC ..... 439/660, 376, 352, 260, 677, 369, 377
See application file for complete search history.

(56) References Cited

U.S. PATENT DOCUMENTS 1,967,021 A * 7/1934 Jacques ..... H01R 13/62 439/469
2,891,103 A * 6/1959 Swengel ..... H01R 13/743 174/153 G
3,078,433 A * 2/1963 Sheesley ..... H01R 13/62 439/278
3,697,927 A * 10/1972 Kunkle ..... H01R 24/28 439/374
3,790,923 A * 2/1974 Mathe ..... H01R 13/743 248/27.3
D242,720 S * 12/1976 Loforese ..... D13/146
D249,502 S * 9/1978 Rink ..... D13/147
4,449,776 A * 5/1984 Carmo ..... H01R 13/6271 439/350
D281,416 S * 11/1985 Buscher ..... D13/147
5,399,102 A * 3/1995 Devine ..... H01R 31/06 439/180
5,704,809 A * 1/1998 Davis ..... H01R 13/434 439/349
6,000,951 A * 12/1999 Hansen ..... H01R 12/79 439/496
6,244,882 B1 * 6/2001 Greenstein ..... A61N 1/3752 439/205
6,296,523 B1 * 10/2001 Sasai ..... B29C 45/26 439/607.09

(Continued)

*Primary Examiner* — Alexander Gilman
(74) *Attorney, Agent, or Firm* — Blank Rome LLP

(57) ABSTRACT

An electrical connector assembly that includes a first connector component that has a housing supporting at least one first exposed contact at an interface surface thereof and has a body portion for terminating a first cable. A second connector component is adapted to slidably receive the first component such that the components are mated and unmated in the same direction. The second component includes a housing supporting at least one second exposed contact at an interface surface thereof and has a body portion for terminating a second cable. When the first component is received in the second component, the components are mated such that the first exposed contact engages the second exposed contact, thereby forming a first electrical connection therebetween and a longitudinal axis of the first cable is spaced from and substantially parallel to a longitudinal axis of the second cable.

25 Claims, 5 Drawing Sheets

(56) References Cited

U.S. PATENT DOCUMENTS 6,305,962 B1 * 10/2001 Maher ..... H01R 13/585 439/27
6,457,988 B1 * 10/2002 Andersen ..... H01R 13/567 439/137
6,506,078 B1 * 1/2003 Mori ..... H01R 13/6593 439/108
6,749,464 B2 * 6/2004 Obata ..... H01R 13/6582 439/578
6,890,210 B2 * 5/2005 Lee ..... H01R 4/2454 439/397
6,969,274 B2 * 11/2005 Kudo ..... H01R 12/87 439/495
6,971,904 B2 * 12/2005 Wallmeier ..... H01R 4/2454 439/417
7,033,203 B2 * 4/2006 Titchener ..... G02B 6/3825 439/191
7,261,580 B1 * 8/2007 Secora ..... H01R 12/83 439/341
7,351,098 B2 * 4/2008 Gladd ..... H01R 9/037 439/271
7,524,214 B2 * 4/2009 Johnson ..... H01R 9/2675 439/701
8,052,464 B2 * 11/2011 Maruishi ..... H01R 12/61 439/496
8,550,832 B2 * 10/2013 Regnier ..... H01R 4/2429 439/260
8,585,427 B2 * 11/2013 Ukawa ..... H01R 13/627 439/377
8,591,247 B2 * 11/2013 Zhu ..... H01R 13/6273 439/352
8,602,811 B2 * 12/2013 Takahashi ..... H01R 12/716 439/376
8,747,142 B2 * 6/2014 Zhang ..... H01R 13/6275 439/354
9,004,953 B2 * 4/2015 Finona ..... H01R 13/6473 439/660

* cited by examiner

ELECTRICAL CONNECTOR ASSEMBLY

FIELD OF THE INVENTION

The present invention relates to an electrical connector assembly that provides one-way mating of its components such that mating and unmating of the components may be accomplished using one hand.

BACKGROUND OF THE INVENTION

Conventional electrical connectors typically include mating plug and receptacle components. Mating and unmating of the conventional plug and receptacle components is often difficult in tight spaces, such as in an airplane cabin, because such requires the use of two hands. Moreover, often times a user may not be able to view the components, thereby making it difficult to plug in and unplug the components.

Therefore, a need exists for an electrical connector assembly that can be easily mated and unmating, particularly in tight spaces and/or where the connector cannot be seen.

SUMMARY OF THE INVENTION

Accordingly, the present invention provides an electrical connector assembly that includes a first connector component, such as a plug, that includes a housing supporting at least one first exposed contact at an interface surface thereof, and the housing has a body portion for terminating a first cable. The first cable defines a longitudinal axis. A second connector component, such as a receptacle, is adapted to slidably receive the first connector component such that the first and second connector components are mated and unmated in the same direction. The second connector component includes a housing supporting at least one second exposed contact at an interface surface thereof corresponding to the at least one first exposed contact. The housing of the second connector component has a body portion for terminating a second cable. The second cable defines a longitudinal axis. When the first connector component is received in the second connector component, the first and second connector components are mated such that the at least one first exposed contact engages the at least one second exposed contact, thereby forming a first electrical connection between the first and second connector components, and the longitudinal axis of the first cable is spaced from and substantially parallel to the longitudinal axis of said second cable.

The present invention may also provide an electrical connector assembly that includes a plug including a plug housing supporting a plurality of plug contacts exposed at an interface surface thereof. The plug housing has a body portion for terminating a first cable. The first cable defines a longitudinal axis. A receptacle is adapted to slidably receive the plug such that the plug and receptacle are mated and unmated in the same direction. The receptacle includes a receptacle housing that supports a plurality of receptacle contacts exposed at an interface surface thereof. The receptacle housing has a body portion for terminating a second cable. The second cable defines a longitudinal axis. The receptacle housing has an open face portion defined by the interface surface of the receptacle housing and a plurality of arms extending outwardly therefrom, thereby defining a receiving area for receiving the plug housing. When the plug is received in the receiving area of the receptacle, the plug and receptacle are mated such that the plurality of plug contacts engage each of the plurality of receptacle contacts, respectively, thereby forming a first electrical connection between the plug and said receptacle, and the longitudinal axis of the first cable is spaced from and substantially parallel to the longitudinal axis of said second cable.

The present invention may further provide a method of mating and unmating first and second connector components of an electrical connector assembly that includes the steps of providing a first connector component including a housing supporting at least one first exposed contact at an interface surface thereof, the housing having a body portion for terminating a first cable; providing a second connector component adapted to slidably receive the first connector component, the second connector component including a housing supporting at least one second exposed contact at an interface surface thereof corresponding to the at least one first exposed contact, the housing of the second connector component having a body portion for terminating a second cable and a receiving area for receiving the first connector component; inserting the first cable into the receiving area; pulling the first cable along an axis substantially parallel to a longitudinal axis of the second connector component until the first connector component is received in the receiving area of the second connector component and the at least one first exposed contact engages the at least one second exposed contact, thereby mating the first and second connector components; and actuating a release mechanism of the first connector component while pulling the first cable along the axis substantially parallel to the longitudinal axis of the second connector component until the first connector component is free from the second connector component, thereby unmating the first and second connector components.

With those and other objects, advantages, and features of the invention that may become hereinafter apparent, the nature of the invention may be more clearly understood by reference to the following detailed description of the invention, the appended claims, and the several drawings attached herein.

DETAILED DESCRIPTION OF THE EXEMPLARY EMBODIMENTS

Figure 1:
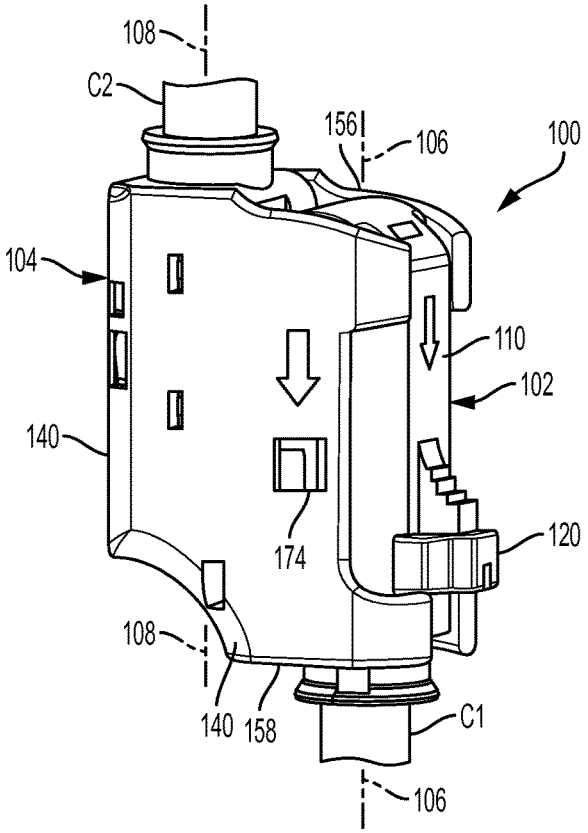
FIG. 1 is a perspective side view of the electrical connector assembly according to an exemplary embodiment of the present invention.

It is to be understood that the figures and descriptions of the present invention may have been simplified to illustrate elements that are relevant for a clear understanding of the present invention, while eliminating, for purposes of clarity, other elements found in an electrical connector assembly. Those of ordinary skill in the art will recognize that other elements may be desirable and/or required in order to implement the present invention. However, because such elements are well known in the art, and because they do not facilitate a better understanding of the present invention, a discussion of such elements is not provided herein. It is also to be understood that the drawings included herewith only provide diagrammatic representations of the presently preferred structures of the present invention and that structures falling within the scope of the present invention may include structures different than those shown in the drawings. Reference will now be made to the drawings wherein like structures are provided with like reference designations.

The following is detailed description of an exemplary embodiment of the present invention in combination with FIGS. 1, 2A-2C, 3-6, and 7A-7C. The present invention generally provides an electrical connector assembly 100 designed such that the connector components 102 and 104 thereof can mate and unmate in the same direction, thereby facilitating the mating and unmating process. This design of the electrical connector assembly 100 of the present invention may, for example, allow a user to employ only one hand when mating and unmating the components 102 and 104. That is particularly useful when the electrical connector assembly 100 is located a tight space in which only one hand can fit and/or where there is no visual of the components.

A first connector component 102 of the connector assembly 100 terminates a first cable C1. The first connector component 102 may be a plug, for example. A second connector component 104 terminates a second cable C2. The second connector component 102 may be a receptacle, for example, designed to receive the plug. Each the first and second cables C1 and C2 define a longitudinal axis 106 and 108, respectively. The longitudinal axes 106 and 108 are preferably spaced from and substantially parallel to one another when the first and second connector components 102 and 104 are mated, as seen in FIG. 1. When mated, the first and second connector components 102 and 104 electrically connect to each other and the first and second cables C1 and C2.

Figure 2A:
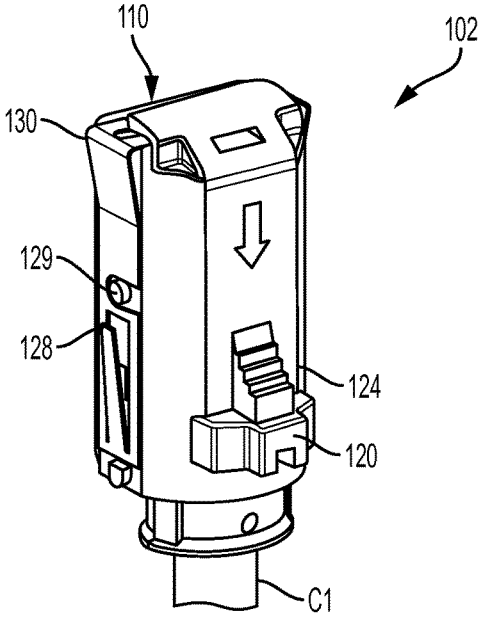
FIG. 2A is a perspective view of a first connector component of the electrical connector assembly illustrated in FIG. 1.
Figure 2B:
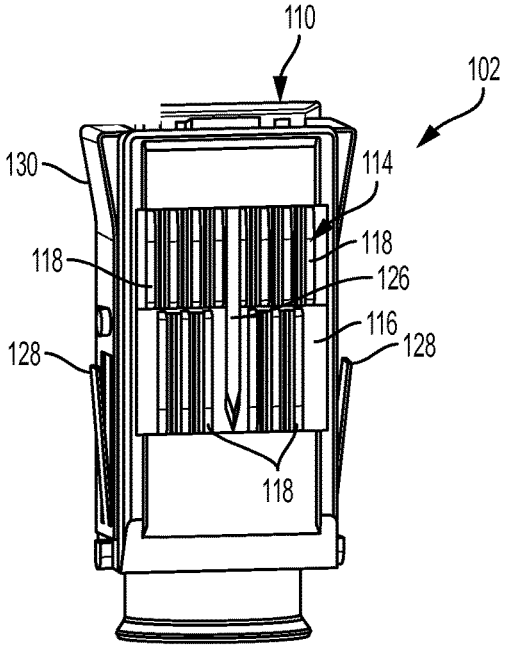
FIG. 2B is another perspective view of the first connector component illustrated in FIG. 2A.
Figure 2C:
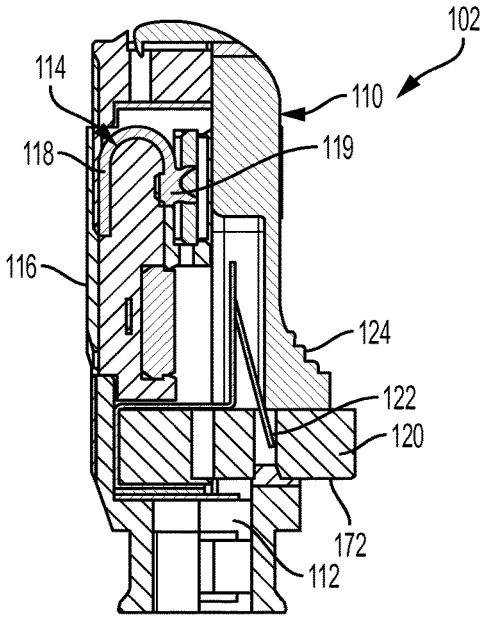
FIG. 2C is a cross-sectional view of the first connector component illustrated in FIG. 2A.
Figure 4:
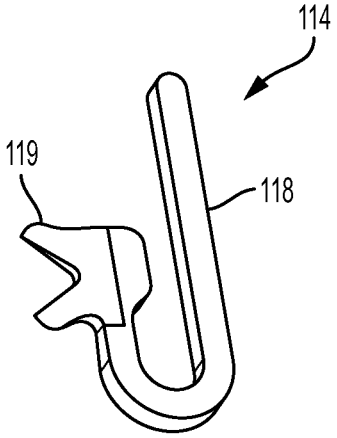
FIG. 4 is a perspective view of a contact of the first connector component illustrated in FIG. 2B.

As seen in FIGS. 2A-2C, the first connector component 102 generally includes a housing 110 that has a body portion 112 for terminating the cable C1 and supporting one or more contacts 114. The housing 110 includes an interface surface 116 with a plurality of slots corresponding to the number of contacts 114 for exposing portions thereof. The exposed portions of the contacts 114 preferably define contact pads 118 that engage corresponding contacts of the second connector component. The ends 119 of the contacts 114 opposite the contact pads 118 electrically and mechanically connect to the wires of cable C1. Each contact end 119, may be for example, an insulation displacement end, for piercing the insulation of the wire and engaging the wire, as seen in FIG. 4. In one embodiment, the exposed contact pads 118 may be presented in multiple rows where each row may have more, less or the same number of contacts 114 than the other rows, as seen in FIG. 2B, for example.

Figure 3:
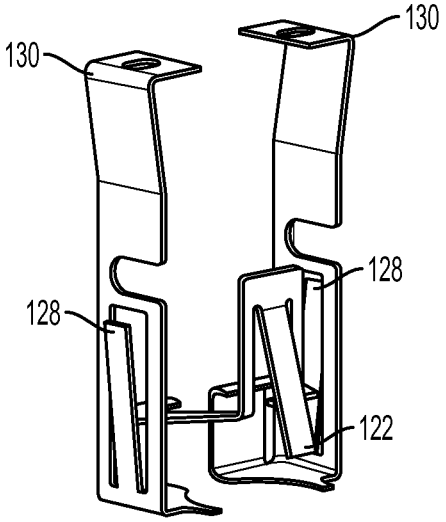
FIG. 3 is a perspective view of a retaining member of the first connector component illustrated in FIG. 2A.
Figure 7C:
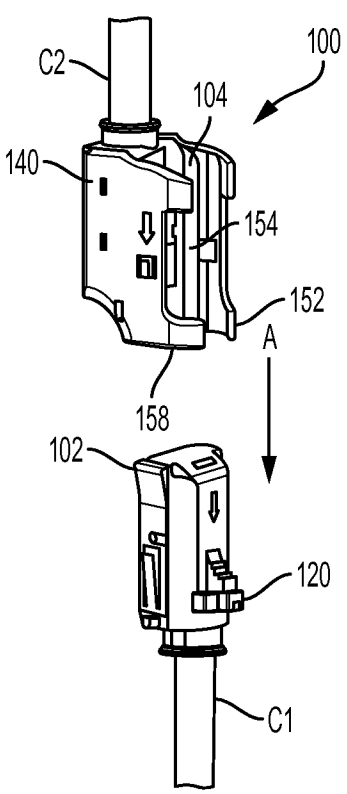
FIGS. 7A-7C illustrate a method according to an exemplary embodiment of the present invention, showing first and second connector components of the electrical connector assembly being mating and unmated in the same direction.
Figure 7B:
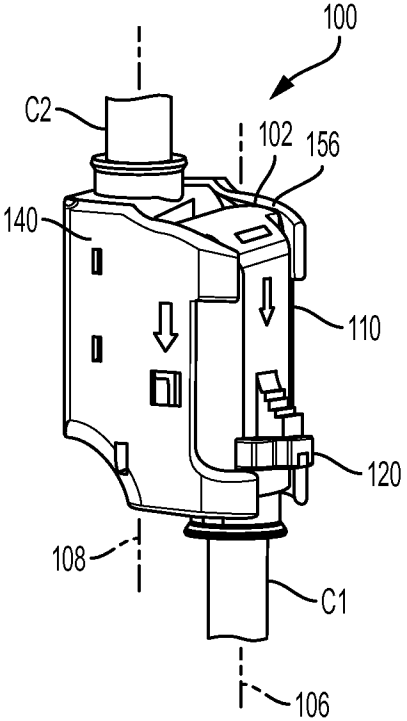

Opposite the interface surface 116 is a stop member 120 extending from the housing, as seen in FIGS. 2A and 2C, for abutting the second connector component 104 during mating. The stop member 120 is movable between a stop position, when the stop member 120 abuts the second connector component 104, as seen in FIGS. 1 and 7B, and a release position, when the stop member 120 is clear of the second connector component 104, as seen in FIG. 7C, thereby providing a release mechanism for the assembly. The stop member 120 is generally movable in an axial direction transverse to the longitudinal axis 106. A biasing member 122 may be provided inside of the housing 110 for biasing the stop member 120 in its stop position, as seen in FIG. 2C. The biasing member 122 may be a spring arm, for example, as seen in FIG. 3, that engages the back of the stop member 120. Adjacent the stop member 120 may be an outer gripping surface 124, which may include ridges or knurls, for example, for facilitating gripping of the first connector component 102 and insertion of the same into the second connector component 104 for mating and unmating purposes. The surface 124 may also protect the stop member 120.

To facilitate alignment with the second connector component 104, the housing 110 of the first connector component 102 may include an alignment member 126. In a preferred embodiment, the alignment member 126 is positioned on the interface surface 116 of the housing 110. The alignment member 126 may be, for example, a longitudinal key positioned between the contact pads 118, as seen in FIG. 2B. The housing 110 may further include one or more retaining members 128 for retaining the first connector component 102 in engagement with the second connector component. The retaining members 128 may be for example, spring arm extensions angled outwardly from the housing 110, as seen in FIGS. 2B and 3. Pins 129 may also be provided on the housing 110 that act as retaining members for engaging corresponding retaining members of the second connector component 104.

The housing 110 of the first connector component 102 may also include one more outwardly tapered surfaces 130, as seen in FIGS. 2B and 3. The outwardly tapered surfaces 130 are designed to engage the second connector component 104 to ensure contact between the housing of the first and second connector components 102 and 104. As seen in FIG. 3, the biasing member 122, the retaining members 128 and the outwardly tapered surfaces 130 may be formed as a one-piece frame, that is incorporated into the housing 110.

Figure 5:
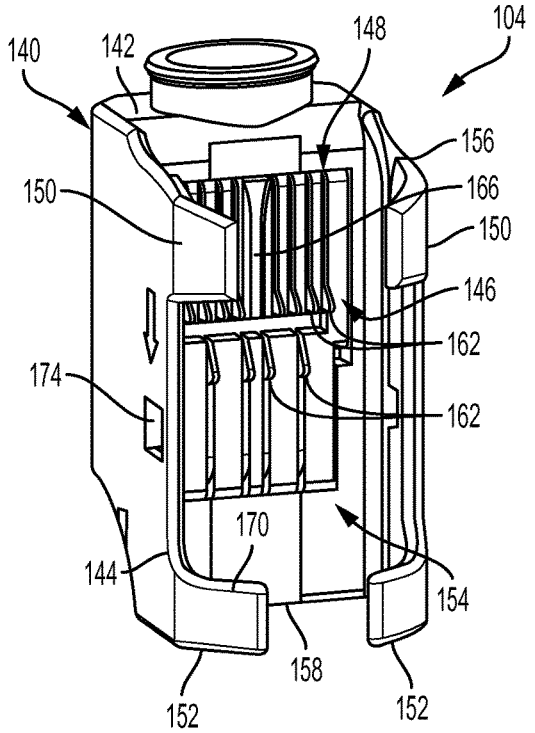
FIG. 5 is a perspective view of a second connector component of the electrical connector assembly illustrated in FIG. 1.
Figure 6:
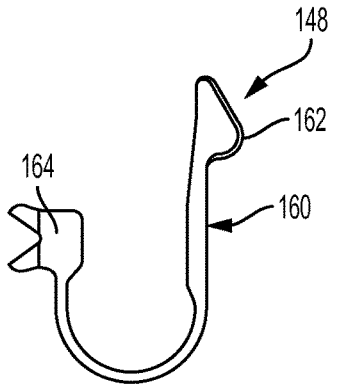
FIG. 6 is a perspective view of a contact of the second connector component illustrated in FIG. 5.
Figure 7A:
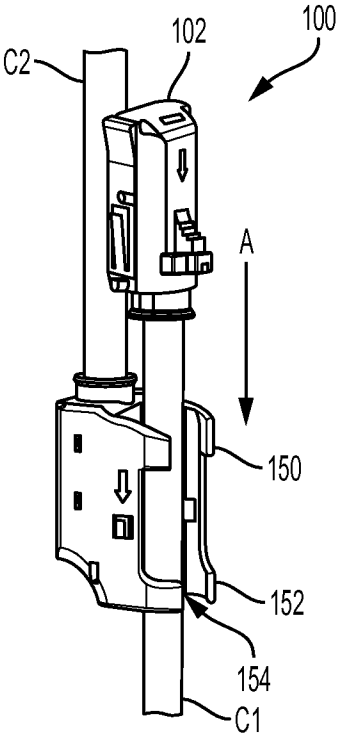

The second connector component 104 is configured to slidably receive the first connector component 102 in a direction A (FIG. 7A). The second connector component 104 generally includes a housing 140 with a body portion 142 for terminating the cable C2 and with an open face portion 144 for receiving the housing 110 of the first connector component 102. The open face portion 144 includes an interface surface 146 that engages the interface surface 116 of the first connector component 102 and a plurality of arms 150 and 152 extending from the interface surface 146. The interface surface 146 supports a plurality of contacts 148 for engaging the contacts 114 of the first connector component 102. The plurality of arms 150 and 152 of the open face portion 144 preferably curve slightly inwardly, as seen in FIG. 5. A receiving area 154 for receiving the first connector component 102 is defined between the interface 146 and the plurality of arms 150 and 152. The arms 150 and 152 help align the first connector component 102 as it enters the second connector component 104. Pins 129 on the sides of the first connector component 102 may act as guides by engaging corresponding retaining members, such as grooves on the inside of the second connector component 104, for further alignment of the components.

A first set of the plurality of arms 150 is located at an entrance 156 of the receiving area 154 and a second set of the plurality of arms 152 is located at an exit 158 of the receiving area 154. In a preferred embodiment, the ends of the arms of the first set of arms 150 are wider apart than the ends of the arms of the second set of arms 152. That allows the housing 110 of the first connector component 102, to be inserted (in direction A) in and enter the receiving area 154 of the second connector component 104 via the entrance 156 without the first set of arms 150 obstructing the stop member 120 of the first connector component 102. The second set of arms 152 of the second connector component 104 provide an abutment or stop for the stop member 120 of the first connector component 102, thereby preventing the first connector component 102 from extending through the exit 158 of the receiving area 154 of the second connector component. In particular, the surface 170 of the arms 150 that faces the receiving area entrance 156 abuts the surface 172 of the stop member 120 that faces the exit 158 of the receiving area 154. It is not until the stop member 120 is moved inwardly with respect to the housing 110 to its release position, that the housing 110 of the first connector component 102 can clear the arms 152 and the receiving area 154 of the second connector component 104 to unmate the components.

The contacts 148 preferably include an exposed portion 160 extending through slots of the interface surface 146. Each exposed contact portion 160 may include a spring head 162 configured and sized to springingly engage the individual contact pads 118 of the first connector component 102. Like the contact pads 118, the exposed contact portions 160 may be arranged in one or more rows with one row having more, less or the same number of contacts 148 as the other rows. The end 164 of each contact 148 opposite the head 162 mechanically and electrically couples to the wires of the cable C2. The ends 164 may be, for example, insulation displacement ends that pierce the insulation of the cable wires and engage the wires.

The housing 140 of the second connector component 104 may include an alignment member 166 that corresponds to the alignment member 126 of the first connector component 102 for facilitating alignment of the components 102 and 104 when mated, particularly alignment of the contact pads 118 and the contact heads 162. The alignment member 166 of the second connector component 104 is preferably positioned near the contacts 148 to match the location of the alignment member 126 of the first connector component 102. The alignment member 166 may be, for example, a longitudinal groove corresponding to the longitudinal key of the interface surface 116 of the first connector component 102. Alternatively, the alignment member 126 of the first connector component 102 may be a longitudinal groove and the alignment member 166 of the second connector component 104 may be a longitudinal key. Also, more than one alignment member 126 and 166 may be provided on the components 102 and 104, respectively.

The housing 140 of the second connector component 104 preferably includes one or more retaining members 174 that correspond to the one or more retaining members, such as spring arm extensions 128, of the first connector component housing 110. The retaining members 174 may be, for example, an opening located in the sidewalls of the open face portion 144 of the housing 140, as seen in FIGS. 1 and 5. Each opening 174 is sized to accept the spring arm extensions 128 of the housing 110 of the first connector component 102. Because the spring arm extensions 128 are angled outwardly, the ends thereof will engage the openings 174 as the first connector component 102 is being inserted into the second connector component 104.

To mate the first and second connector components 102 and 104, the cable C1 of the first connector component 102 is inserted into the receiving area 154 of the second connector component 104, preferably between the sets of arms 150 and 152, as seen in FIG. 7A. The cable C1 can then be pulled in direction A, which is substantially parallel to the longitudinal axes 106 and 108, until first connector component 102 enters the entrance 156 and is received in said receiving area 154 of the second connector component 104, as seen in FIGS. 1 and 7B. The operator may also push on the outer gripping surface 124 to help with insertion of the first connector component 102. In the mated position, the interface surfaces 116 and 146 face one another so that the contact pads 118 and the contact heads 162 engage and contact each other, thereby establishing an electrical connection between the components 102 and 104. As the first connector component 102 is being inserted into the second connector component 104, the alignment member or longitudinal key 126 engages the alignment member or longitudinal groove 166 to ensure the contacts 114 and 148 are properly aligned with one another. Also the retaining members or spring arm extensions 128 of the first connector component's housing 110 will extend into the corresponding retaining members or openings 174 of the second connector component's housing 140 to retain the first connector component 102 in place in the receiving area 154 of the second connector component 104.

At least a portion of the housings 110 and 140 are preferably formed of a conductive material to establish another electrical connection between the first and second connector components 102 and 104 when they are mated. This electrical connection provides shielding to the assembly 100. This electrical connection may also be terminated to a wire shield. In a preferred embodiment, the entirety of the housings 110 and 140 are formed of a conductive material. Alternatively, the housings 110 and 140 may be plated with a conductive material. The outwardly tapered surfaces 130 of the housing 110 of the first connector component 102 help facilitate this electrical connection by engaging, preferably via an interference or friction fit, an inner surface of the housing 140 of the second electrical component 104.

To unmate the first and second connector components, the cable C1 is again pulled in the same direction A, as seen in FIG. 7C. At the same time, the operator pushes the release mechanism or stop member 120 inwardly against the bias of biasing member 122 to clear the arms 152 of the second connector component's housing 140 until the first connector component 102 is free from the second connector component 104. Because the connector components 102 and 104 can be mated and unmated in the same direction A, the operator needs only one hand to insert the first connector component 102 into the second connector component 104 and only one hand to subsequently release the components 102 and 104. That is particular useful in tight spaces where an operator may be unable to fit both hands and/or where there is no visual of the components.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

It should be understood that the inventive concepts set forth herein are not limited in their application to the construction details or component arrangements set forth in the description or illustrated in the drawings. It should also be understood that the phraseology and terminology employed herein are merely for descriptive purposes and should not be considered limiting. It should further be understood that any one of the described features may be used separately or in combination with other features. Other invented systems, methods, features, and advantages will be or become apparent to one with skill in the art upon examining the drawings and the detailed description herein. It is intended that all such additional systems, methods, features, and advantages be protected by the accompanying claims

What is claimed is:

1. An electrical connector assembly, comprising:

a first connector component including a housing supporting at least one first exposed contact at an interface surface thereof, said housing having a body portion for terminating a first cable, said first cable defining a longitudinal axis; and a second connector component adapted to slidably receive said first connector component such that said first and second connector components are mated and unmated in the same direction, said second connector component including a housing supporting at least one second exposed contact at an interface surface thereof corresponding to said at least one first exposed contact, said housing of said second connector component having a body portion for terminating a second cable, said second cable defining a longitudinal axis, wherein when said first connector component is received in said second connector component, said first and second connector components are mated such that said at least one first exposed contact engages said at least one second exposed contact, thereby forming a first electrical connection between said first and second connector components, and said longitudinal axis of said first cable is spaced from and substantially parallel to said longitudinal axis of said second cable.

2. An electrical connector assembly according to claim 1, wherein said housing of said first connector component has at least a portion that is conductive; and said housing of said second connector component has at least a portion that is conductive which contacts said at least a portion that is conductive of said housing of said first connector component, thereby forming a second electrical connection between said first and second connector components when said first and second connector components are mated.

3. An electrical connector assembly according to claim 1, further comprising a first alignment member extending along said interface surface of said first connector component; and a second alignment member extending along said interface surface of said second connector component that is adapted to engage said first alignment member.

4. An electrical connector assembly according to claim 3, wherein said first alignment member is a longitudinal key; and said second alignment member is a longitudinal groove that adapted to receive said longitudinal key.

5. An electrical connector assembly according to claim 1, wherein said housing of said first connector component includes a stop member for abutting said housing of said second connector component.

6. An electrical connector assembly according to claim 5, wherein said stop member moves between a stop position, when said stop member abuts said housing of said second connector component, and a release position, when said stop member is clear of said housing of second connector component, and a biasing member that biases said stop member in said stop position.

7. An electrical connector assembly according to claim 1, wherein said housing of said first connector component includes at least one retaining member configured to engage a corresponding retaining member of said housing of said second connector component for retaining said first connector component in said housing od said second connector component.

8. An electrical connector assembly according to claim 1, wherein said housing of said first connector component having at least one outwardly tapered surface that is conductive for engaging a conductive portion of said housing of said second connector component, thereby forming a second electrical connection between said first and second connector components.

9. An electrical connector assembly according to claim 1, wherein said housing of said first connector component has an outer gripping surface opposite said interface surface of said first connector component.

10. An electrical connector assembly according to claim 1, wherein said at least one first exposed contact has one end forming a pad exposed at said interface surface of said first connector component and a second opposite end for connecting to a wire of said first cable.

11. An electrical connector assembly according to claim 1, wherein said housing of said second connector component includes an open face portion defined by said interface surface of said second connector component and a plurality of arms extending outwardly from said interface surface of said second connector component, said open face portion defining a receiving area for receiving said first connector component.

12. An electrical connector assembly according to claim 11, wherein said plurality of arms includes a first set of arms at an entrance of said receiving area of said open face portion and a second set of arms at an exit of said receiving area of said open face portion.

13. An electrical connector assembly according to claim 12, wherein said first set of arms are wider apart than said second set of arms.

14. An electrical connector assembly according to claim 1, wherein said at least one second exposed contact includes a spring end that has a contact head for engaging said at least one first exposed contact, and an opposite end for connecting to a wire of said second cable.

15. An electrical connector assembly, comprising:

a plug including a plug housing supporting a plurality of plug contacts exposed at an interface surface thereof, said plug housing having a body portion for terminating a first cable, said first cable defining a longitudinal axis; and a receptacle adapted to slidably receive said plug such that said plug and receptacle are mated and unmated in the same direction, said receptacle including a receptacle housing supporting a plurality of receptacle contacts exposed at an interface surface thereof, said receptacle housing having a body portion for terminating a second cable, said second cable defining a longitudinal axis, and said receptacle housing having an open face portion defined by said interface surface of said receptacle housing and a plurality of arms extending outwardly therefrom, thereby defining a receiving area for receiving said plug housing, wherein when said plug is received in said receiving area of said receptacle, said plug and receptacle are mated such that said plurality of plug contacts engage each of said plurality of receptacle contacts, respectively, thereby forming a first electrical connection between said plug and said receptacle, and said longitudinal axis of said first cable is spaced from and substantially parallel to said longitudinal axis of said second cable.

16. An electrical connector assembly according to claim 15, wherein said plug housing is substantially conductive; and said receptacle housing is substantially conductive such that when said plug and receptacle are mated, a second electrical connection is formed between said plug and receptacle.

17. An electrical connector assembly according to claim 15, wherein said plug housing includes a first alignment member extending along said interface surface of said plug housing; and a receptacle includes a second alignment member extending along said interface surface of said receptacle housing that is adapted to engage said first alignment member.

18. An electrical connector assembly according to claim 15, wherein said plug housing includes a stop member that moves between a stop position, when said stop member abuts said receptacle housing, and a release position, when said stop member is clear of said receptacle housing, and a biasing member that biases said stop member in said stop position.

19. An electrical connector assembly according to claim 15, wherein said plug housing includes at least one retaining member that is a spring wing configured to engage a corresponding retaining member of said receptacle housing that is a housing opening sized to receive said spring wing.

20. A method of mating and unmating first and second connector components of an electrical connector assembly, comprising the steps of:

providing a first connector component including a housing supporting at least one first exposed contact at an interface surface thereof, said housing having a body portion for terminating a first cable;

providing a second connector component adapted to slidably receive said first connector component, said second connector component including a housing supporting at least one second exposed contact at an interface surface thereof corresponding to said at least one first exposed contact, said housing of said second connector component having a body portion for terminating a second cable and a receiving area for receiving said first connector component;

inserting said first cable into said receiving area;

pulling said first cable along an axis substantially parallel to a longitudinal axis of said second connector component until said first connector component is received in said receiving area of said second connector component and said at least one first exposed contact engages said at least one second exposed contact, thereby mating the first and second connector components; and actuating a release mechanism of said first connector component while pulling said first cable along said axis substantially parallel to said longitudinal axis of said second connector component until said first connector component is free from said second connector component, thereby unmating said first and second connector components.

21. A method according to claim 20, further comprising the steps of plating said housing of said first connector component with a conductive material; and plating said housing of said second connector component with a conductive material, thereby forming a second electrical connection between said first and second connector components when said first and second connector component are mated.

22. A method according to claim 20, further comprising the step of aligning a first alignment member of said housing of said first connector component with a second alignment member of said housing of said second connector component thereby aligning said first and second connector components when mating said first and second connector components.

23. A method according to claim 20, further comprising the step of gripping an outer gripping surface of said housing of said first connector component when an outer gripping surface when inserting said housing of said first connector component into said receiving area of said second connector component.

24. A method according to claim 20, wherein said release mechanism is a stop member on plug housing that moves between a stop position, when said stop member abut said housing of said second connector component, and a release position, when said stop member is clear of said housing of said second connector component.

25. A method according to claim 20, wherein the step of inserting said first cable into said receiving area includes inserting said first cable between outwardly extending arms of said housing of said second connector component.

* * * * *